US008613180B2

(12) United States Patent
Strickland et al.

(10) Patent No.: US 8,613,180 B2
(45) **Date of Patent: *Dec. 24, 2013**

(54) INSULATED DOOR AND METHOD OF MAKING SAME

(71) Applicant: Assa Abloy Door Group, LLC, New Haven, CT (US)

(72) Inventors: Bobby Neal Strickland, Trenton, TN (US); John A. Wilkinson, Big Sandy, TN (US); Dale Childers, Milan, TN (US); Michael Campbell, Jackson, TN (US)

(73) Assignee: Assa Abloy Door Group, LLC, New Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/774,100

(22) Filed: Feb. 22, 2013

(65) Prior Publication Data

US 2013/0180206 A1 Jul. 18, 2013

Related U.S. Application Data

(63) Continuation of application No. 12/423,449, filed on Apr. 14, 2009, now Pat. No. 8,418,427.

(51) Int. Cl.
*E04B 1/00* (2006.01)
*E04G 21/00* (2006.01)

(52) U.S. Cl.
USPC ..... 52/742.13; 52/458; 52/309.9; 52/784.15; 52/404.3; 52/309.4; 52/404.2; 52/404.5; 52/783.12; 49/501; 49/504

(58) Field of Classification Search
USPC ..... 52/457, 458, 309.9, 784.13, 784.15, 52/800.13, 404.3, 309.4, 216, 404.2, 52/404.5, 784.1, 784.16, 784.14, 784.12, 52/784.11, 783.1, 783.12, 204.54, 742.13, 52/745.14, 741.1; 49/501, 504
See application file for complete search history.

(56) References Cited

U.S. PATENT DOCUMENTS

| | | | |
|---|---|---|---|
| 1,159,411 | A | 11/1915 | Olberg |
| 2,677,443 | A | 5/1954 | Kottick |
| 3,299,595 | A | 1/1967 | Munk |
| 3,455,078 | A | 7/1969 | Brown |
| 4,118,543 | A | 10/1978 | Donohue |
| 4,589,240 | A | 5/1986 | Kendall |
| 4,811,538 | A | 3/1989 | Lehnert |
| 4,911,883 | A | 3/1990 | Kumagai |
| 4,965,030 | A | 10/1990 | Thorn |
| 5,373,678 | A | 12/1994 | Hesser |

(Continued)

*Primary Examiner* — Chi Q Nguyen
(74) *Attorney, Agent, or Firm* — DeLio & Peterson, LLC; Peter W. Peterson

(57) ABSTRACT

An insulated door comprising a door shell having spaced first and second exterior panels. The door includes a plurality of stiffeners bonded to a liner panel, with thermal insulation between adjacent stiffeners, disposed within the door shell. The liner panel may extend along one side of the stiffeners and the thermal insulation along the liner panel between the stiffeners and the first and second exterior panels. The stiffeners and the liner panel are preferably made of steel and the stiffeners are welded to the liner panel. The stiffeners are preferably not welded to the first and second exterior panels of the door shell. The liner panel is preferably insertable into the first or second exterior panels of the door shell. The insulation material fills substantially all of the space between the liner panel and one of the first or second exterior panels.

26 Claims, 6 Drawing Sheets

(56) References Cited

U.S. PATENT DOCUMENTS

| | | | | |
|---|---|---|---|---|
| 5,509,457 | A | 4/1996 | Jella | |
| 5,522,194 | A | 6/1996 | Graulich | |
| 5,664,870 | A | 9/1997 | Uchida | |
| 6,098,368 | A | 8/2000 | McKann | |
| 6,204,908 | B1 | 3/2001 | Hashimoto | |
| 6,263,628 | B1 | 7/2001 | Griffin | |
| 6,311,454 | B1 | 11/2001 | Kempel | |
| 6,622,449 | B2 | 9/2003 | Smith | |
| 6,681,541 | B2 | 1/2004 | Wang Chen | |
| 6,871,600 | B2 | 3/2005 | Norton | |
| 8,418,427 | B2 * | 4/2013 | Strickland et al. | 52/742.13 |
| 2007/0034110 | A1 | 2/2007 | Zupancich et al. | |

* cited by examiner

INSULATED DOOR AND METHOD OF MAKING SAME

This application is a continuation of U.S. application Ser. No. 12/423,449 filed on Apr. 14, 2009 issued as U.S. Pat. No. 8,418,427 on Apr. 16, 2013.

BACKGROUND OF THE INVENTION

1. Field of the Invention

The present invention relates to insulated steel doors, and in particular, doors having an internal structure for improving rigidity, thermal efficiency, aesthetics and manufacturability.

2. Description of Related Art

Insulated exterior steel doors include an insulation material to resist heat transfer from one side of the door to the opposing side. Typically, the door contains a foam panel for insulation, for example, as described in ANSI/NAAMM HMMA 867-06 part 2.01.A.2.a-d. The insulation provides for a thermally efficient door, but the insulation in an otherwise hollow door provides very little structural integrity.

Steel doors which include structural stiffening elements are usually thermally inefficient due to the transfer of heat from the door interior to the door exterior through the structural elements, for example, as described in ANSI/NAAMM HMMA 867-06 part 2.01.A.2.e. Additionally, where the structural elements are welded to the door skin, weld marks are usually apparent.

SUMMARY OF THE INVENTION

Bearing in mind the problems and deficiencies of the prior art, it is therefore an object of the present invention to provide an insulated steel door which improves the structural integrity, is thermally efficient and provides an outer appearance free of weld marks.

It is another object of the present invention to provide a method of making an insulated steel door which improves the structural integrity, is thermally efficient and provides an outer appearance free of weld marks.

A further object of the invention is to provide an economic method for producing an insulated steel door which includes stiffeners, insulation material and a liner bonded to the stiffeners.

Still other objects and advantages of the invention will in part be obvious and will in part be apparent from the specification.

The above and other objects, which will be apparent to those skilled in the art, are achieved in the present invention which is directed to an insulated door comprising a door shell having spaced first and second exterior panels. The door includes a plurality of stiffeners bonded to a liner panel, with thermal insulation between adjacent stiffeners, disposed within the door shell.

The liner panel may extend along one side of the stiffeners and the thermal insulation along the liner panel between the stiffeners and the first and second exterior panels. The stiffeners and the liner panel are preferably made of steel and the stiffeners are welded to the liner panel. The stiffeners are preferably not welded to the first and second exterior panels of the door shell. The liner panel may be disposed against an interior face of the first or second exterior panels. The liner panel is preferably insertable into the first or second exterior panels of the door shell.

The insulation material fills substantially all of the space between the liner panel and one of the first or second exterior panels. The insulation material may be disposed between the stiffeners and at least one of the exterior panels and may bond the stiffeners to the at least one exterior panel.

The liner panel may be self supporting and is preferably bonded to the stiffeners. At least some of the stiffeners have a thickness less than the distance between the first and second exterior panels. The door shell may include door edges extending between a periphery of the first and second exterior panels and may additionally include a hinge for securing the door shell to a door opening.

Another aspect of the invention is directed to a method of making an insulated door. The method includes providing first and second exterior panels for a door shell and a plurality of stiffeners bonded to a liner panel. The method includes installing the liner panel against one of the exterior skin panels of the door shell, installing the other of the exterior panels on a side of the door shell opposite the liner panel, either before or after installing the liner panel and placing an insulation material between adjacent stiffeners of the liner panel, either before or after installing the exterior panel. The step of providing a plurality of stiffeners bonded to a liner panel may include providing the stiffeners welded to the liner panel.

The step of placing the insulation material between adjacent stiffeners may include filling substantially all of the space between the liner panel and one of the first or second exterior panels. Additionally, the step of installing the liner panel against one of the exterior skin panels of the door shell may include installing the liner panel against an interior face of the first or second exterior panels.

The method includes the stiffeners and the liner panel preferably made of steel although the stiffeners are not welded to the first and second exterior panels of the door shell. The door shell may include door edges extending between a periphery of the first and second exterior panels and the method for making the door may include providing a hinge for securing the door shell to a door opening and fastening the hinge to at least one of the door edges at any step of the method.

In the method of making the insulated door, the liner panel is self-supporting and may be a self-supporting insulation material bonded to the stiffeners, wherein the insulation material is present between the stiffeners and at least one of the exterior panels and bonds the stiffeners to the at least one exterior panel. At least some of the stiffeners have a thickness less than the distance between the first and second exterior panels.

In another aspect of the method for making an insulated door the method comprises providing first and second exterior panels for a door shell, a plurality of stiffeners and a hardenable flowable foam. The method includes suspending the plurality of stiffeners between the first and second exterior panels whereby cavities are formed between adjacent stiffeners and between the first and second exterior panels. A space is thereby created between at least one side of the stiffeners and the adjacent exterior panel sufficient to allow the flowable foam to flow between the at least one side of the stiffeners and the adjacent exterior panel. The method includes flowing the foam into the cavities and between the at least one side of the stiffeners and the adjacent exterior panel until cavities are filled with the foam. The flowable foam is allowed to harden whereby the exterior panels and the stiffeners are bonded to the foam. The foam is preferably a two-part foam that expands and hardens upon mixing each of the two parts together. The door shell may include door edges extending between a periphery of the first and second exterior panels and may further include providing a hinge for securing the door shell to a door opening and fastening the hinge to at least one of the door edges at any step of the method.

In a related aspect, the present invention includes a structural panel, such as a wall, floor or ceiling panel, for use in buildings or other structures, which has the structural features and methods of construction as those described above, without the hinges, handles and other door hardware.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-12 of the drawings in which like numerals refer to like features of the invention.

Figure 1:
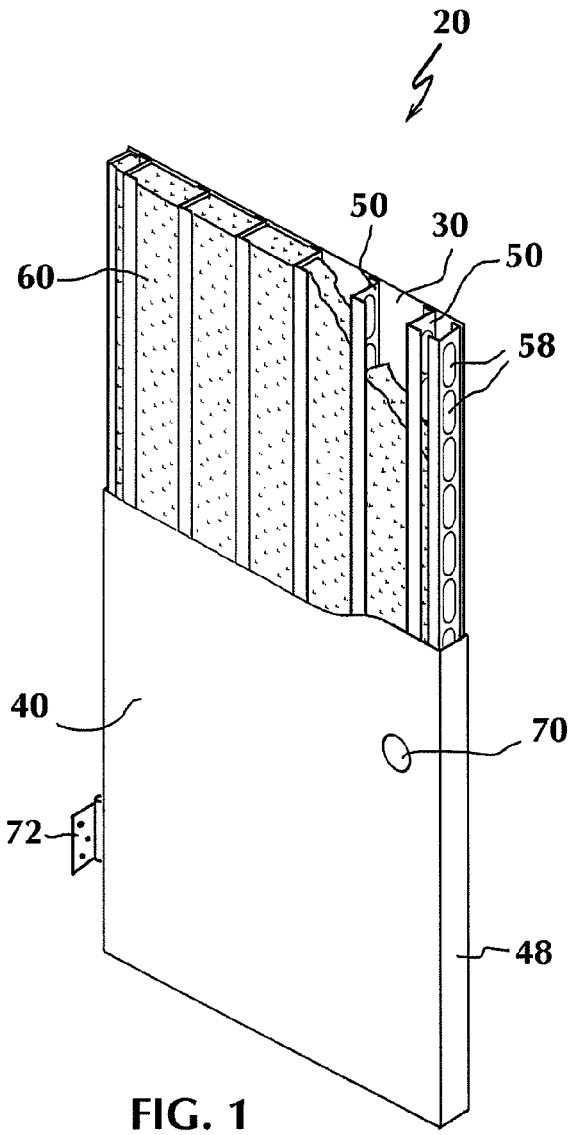
FIG. 1 is a front perspective view with partial cutaway of the steel insulated door according to the present invention.
Figure 2:
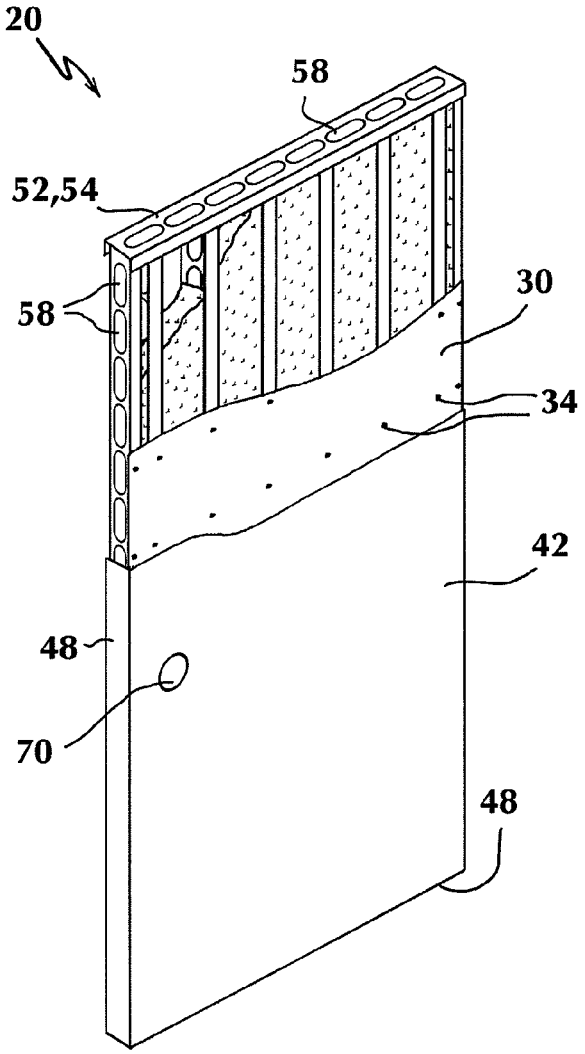
FIG. 2 is a rear perspective view with partial cutaway of the steel insulated door according to the present invention.
Figure 3:
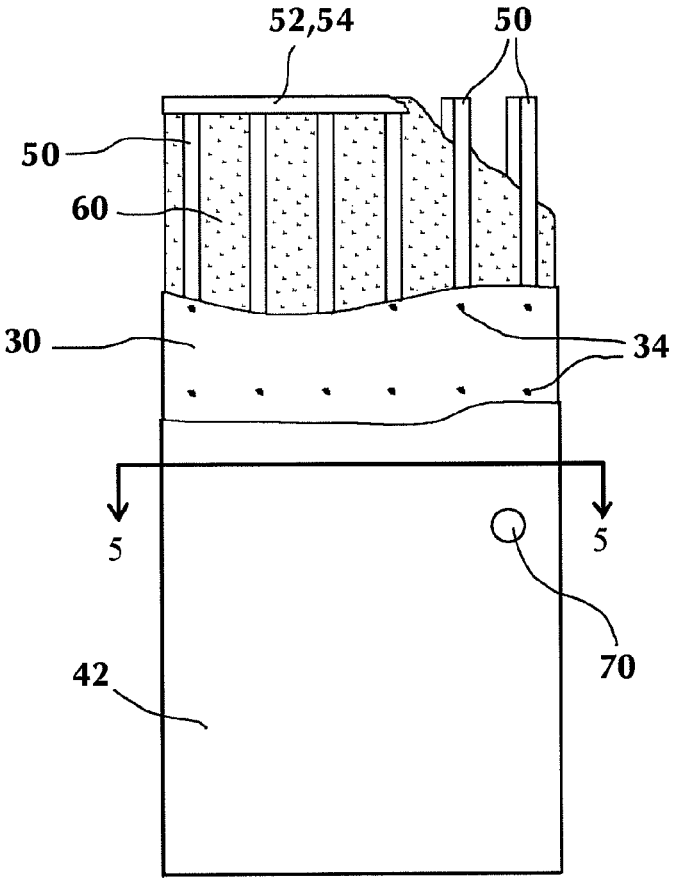
FIG. 3 is a cutaway front elevational view of the steel insulated door according to the present invention.
Figure 4:
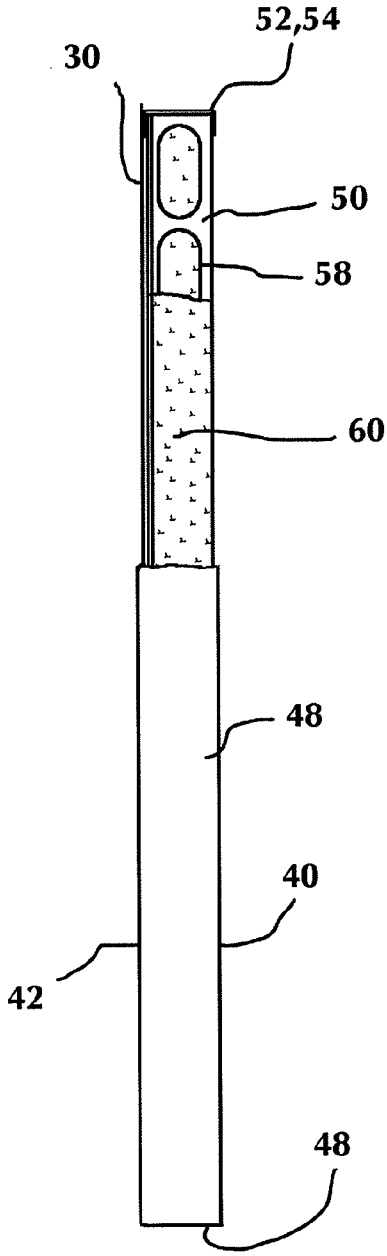
FIG. 4 is a cutaway side elevational view of the steel insulated door according to the present invention.

FIGS. 1 and 2 show the perspective cutaway views of an insulated steel door 20 interior and exterior, respectively. The door shell includes an inner panel 40 and a spaced outer panel 42 opposite the inner panel. The insulated door 20 includes door edges 48 extending between the periphery of the inner and outer panels. The inner panel 40 and outer panel 42 form the exterior panels of the door, and may also be referred to as the door skin. The exterior panels are preferably made of about 20 gauge steel (0.032 in, 0.81 mm), and may be flat or embossed. In the space between the inner and outer panels a plurality of vertical structural stiffeners 50 are bonded to a liner panel 30. The stiffeners are preferably made of about 22 gauge steel (0.029 in, 0.74 mm). The liner panel is preferably made of about 22 gauge steel (0.029 in, 0.74 mm). Although the liner panel may be of a different thickness, it should provide sufficient structural integrity to maintain its shape and form in an upright position prior to bonding to the stiffeners. Typical door skin thickness is preferably in the range of about 0.035 to 0.104 in (0.89 mm to 2.64 mm). Liner thickness is preferably in the range of about 0.029 to 0.250 in. (0.74 to 2.54 mm), and more preferably is at least 0.029 in. (0.074 mm). Materials other than steel may also be employed for the door skin, liner and structural components. The liner panel may also include perforations.

Top and bottom horizontal stiffeners 52, 54 may be included at the top (FIG. 2) and bottom (not shown) of the liner panel and are preferably more rigid than the vertical stiffeners. The stiffeners 50, 52, 54 and liner panel are preferably bonded to the liner by spot-welding as indicated by weld spots 34 on the liner. Other bonding methods and materials may alternatively or additionally be used, including but not limited to adhesives and mechanical fasteners. The stiffeners 50, 52, 54 preferably include openings or slots 58 along substantially the entire length.

Figure 5:
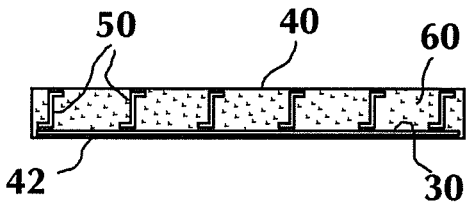
FIG. 5 is a top cross sectional view of the door shown in FIG. 3 along line 5-5.
Figure 6:
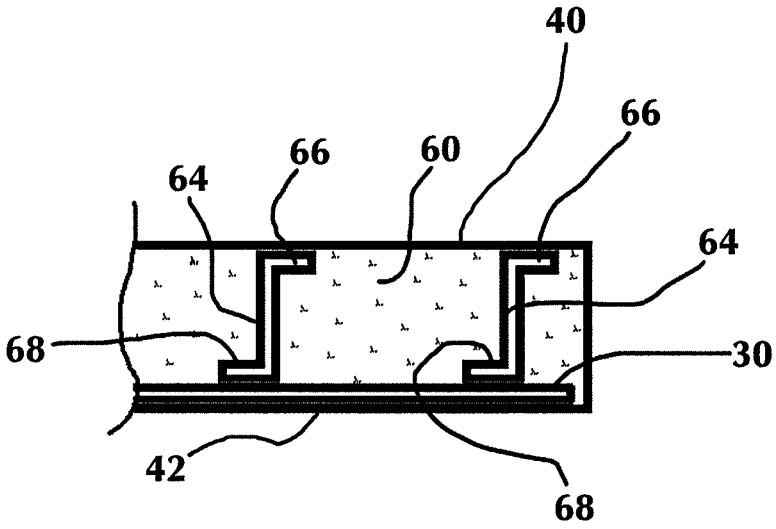
FIG. 6 is an enlarged view of a portion on the top cross sectional view of the door shown in FIG. 5.

As shown in the cross section view of the insulated door of FIGS. 5 and 6, the preferred vertical stiffeners include a central web 64 and opposing end flanges 66, 68 perpendicular to and connected to opposite edges along the length of the central web 64. The central web of the vertical stiffener preferably includes openings or slots 58 along its length. One of the opposing end flanges 66, 68 is bonded to the liner panel and the opposing end flange contacts the door skin or panel 40. Panels 40, 42 may be bonded to the stiffener flanges and liner, respectively. Importantly, the stiffeners need not be welded to the inner and outer panels of the door shell, so that there is no thermally conductive bridge through the door thickness.

An insulation material 60 is disposed between adjacent stiffeners and fills the cavity between the outer panel and the liner. Preferably the insulation material is expanded foam and more preferably is a polyurethane expanding foam. Alternately, fiberglass batts or a paper honeycomb material, or other solid material may be used for insulation. A preparation opening 70 for a lock and/or door handle may be provided, along with hinges 72 (FIG. 1) to secure the door to a door opening (not shown). Alternatively, the present invention may be used as a wall or other structural panel, without the door hardware.

Figure 7:
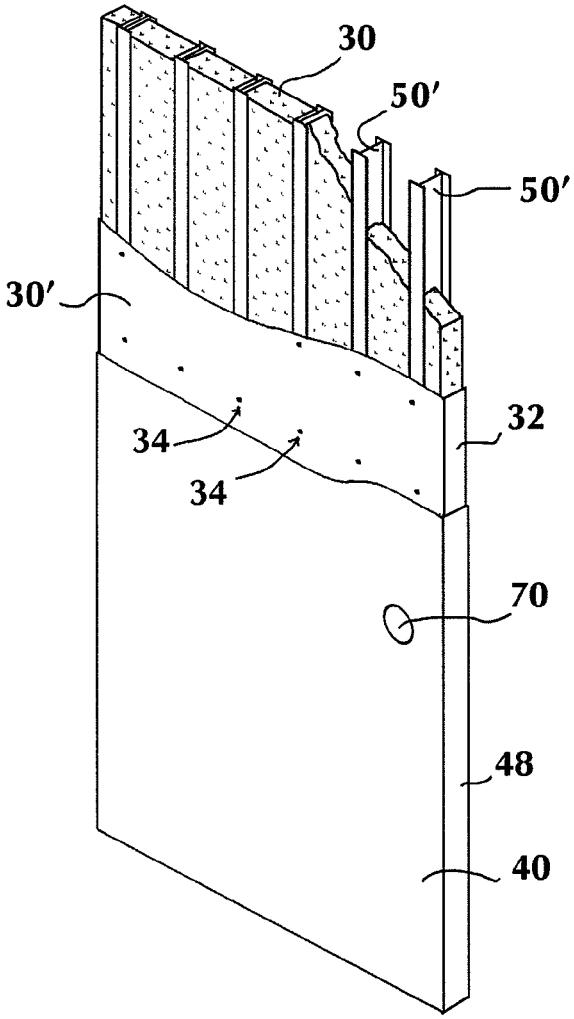
FIG. 7 is a front perspective view of an alternate embodiment of the steel insulated door according to the present invention.
Figure 8:
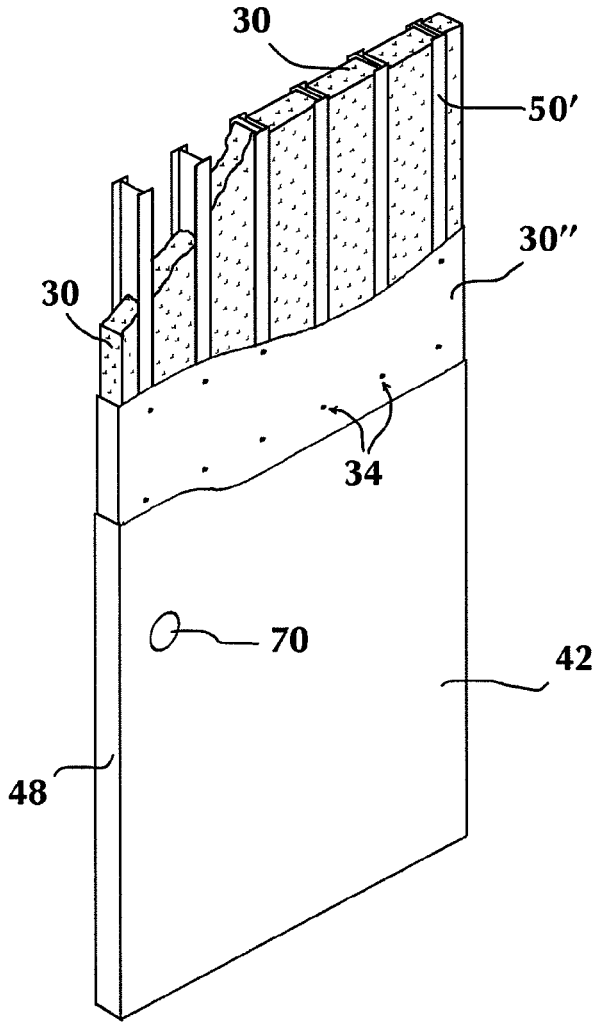
FIG. 8 is a rear perspective view of an alternate embodiment of the steel insulated door according to the present invention.

FIGS. 7 and 8 show an alternate embodiment of the door of the present invention. The liner panel 30' is preferably bonded to only one side of the stiffeners although a second perforated panel 30" may be bonded to the opposite side of the stiffeners. The liner panels 30', 30" may additionally be connected to liner edges 32 extending between the periphery of the liner panels 30', 30". An insulation material is disposed in each cavity formed by opposing adjacent stiffeners and opposing liners 30', 30". The assembled stiffeners/liners/insulation is disposed between the door skin panels. Also shown in FIGS. 7 and 8 is an alternate embodiment of the vertical stiffeners, wherein the vertical stiffeners 50' have an I-beam cross sectional shape.

Figure 9:
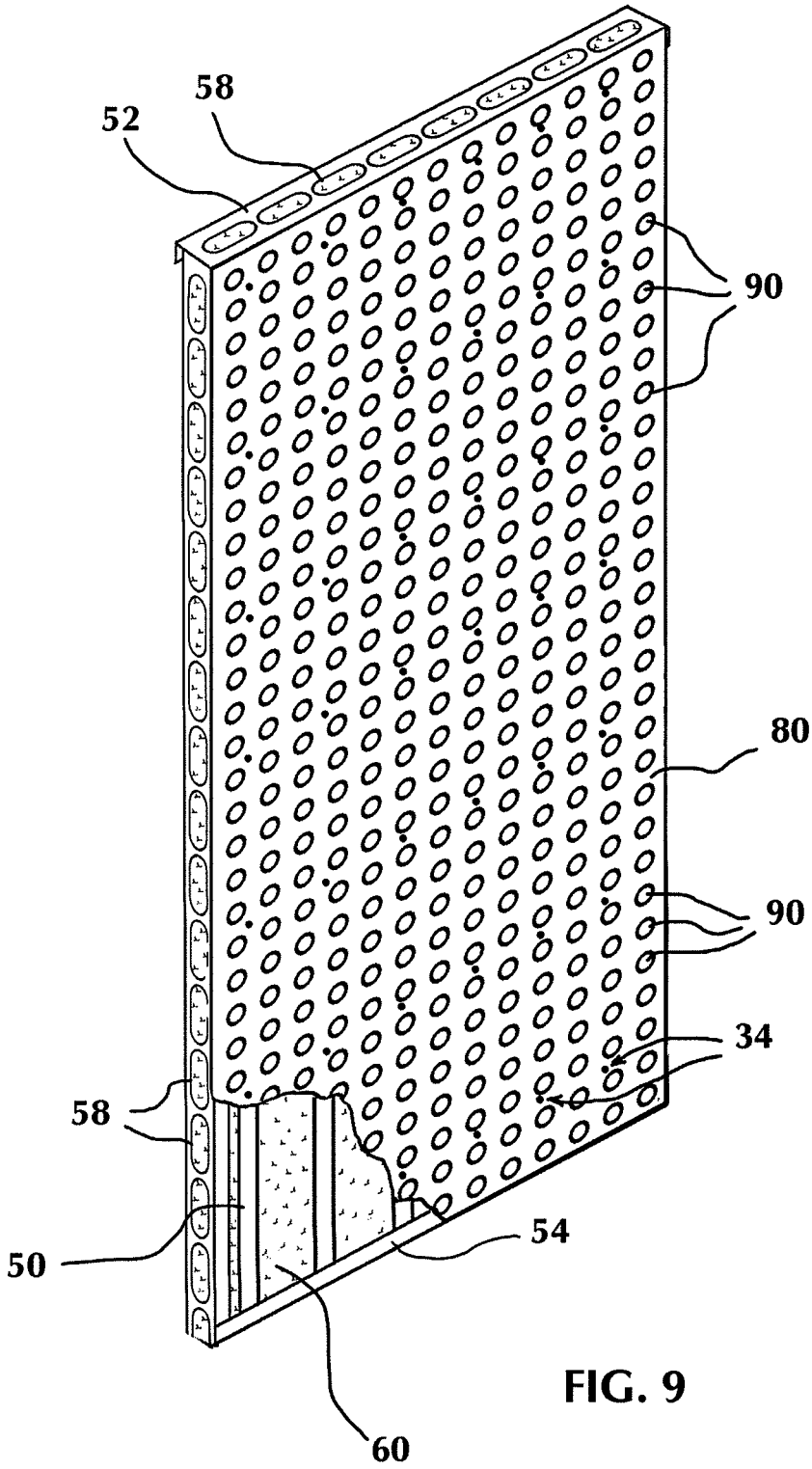
FIG. 9 is a perspective full cutaway view showing the stiffener/liner subassembly and insulation for an alternate embodiment of the liner panel, with the liner panel partially cutaway.

FIG. 9 shows an alternate embodiment of a liner panel 80 having perforations 90. The liner panel 80 is bonded to the stiffeners 50. The liner panel 80 is preferably welded to the stiffeners and produces weld spots 34 on the liner 80. The liner panel is preferably bonded to only one side of the stiffeners although a second perforated panel may be bonded to the opposite side of the stiffeners.

Referring back to FIGS. 1 and 2, in a method for making the insulated steel door, a plurality of stiffeners 50, 52, 54 are bonded to a liner panel 30, preferably by spot welding each stiffener to the liner in several locations along the length of the stiffener. In one embodiment of the method of making the insulated door of the present invention, this stiffener/liner subassembly is placed against one of the inner or outer panels 40, 42, preferably with the liner directly against that panel, and then the other of the inner or outer panels is applied. A flowable foam is then injected between the stiffeners through any open end of the door shell. The flowable foam is preferably a foam material that expands upon contact with the atmospheric air or alternately a two-part foam that expands upon mixing the two parts together. The stiffeners 50, 52, 54 include openings or slots along the stiffener length which allow the expanding foam to flow from one cavity to an adjacent cavity. In a preferred embodiment of the method of making the insulated door, the subassembly is inserted into one skin. Alternately, the foam may be injected through small holes in at least one of the door edges 58.

In another embodiment of the method of making the insulated door of the present invention, the stiffener/liner subassembly is placed against one of the inner or outer panels 40, 42, with the liner directly against that panel, and then the insulation is applied between the stiffeners. This method is preferred when insulation batts or other aforementioned materials are used. After the insulation is in place, the other of the inner or outer panels is applied.

Referring to FIG. 9 in an alternate method of making the insulated steel door, a plurality of stiffeners 50, 52, 54 are bonded to a liner panel 80, preferably by spot welding each stiffener to the liner in several locations along the length of the stiffener. This stiffener/liner subassembly is inserted into the door skin between the inner and outer panels 40, 42 and the foam is then injected between the stiffeners. When fiberglass batts or other aforementioned materials are used for the insulation material 30, the insulation may be inserted into the stiffener/liner subassembly prior to insertion between the inner and outer panels 40, 42.

Figure 10:
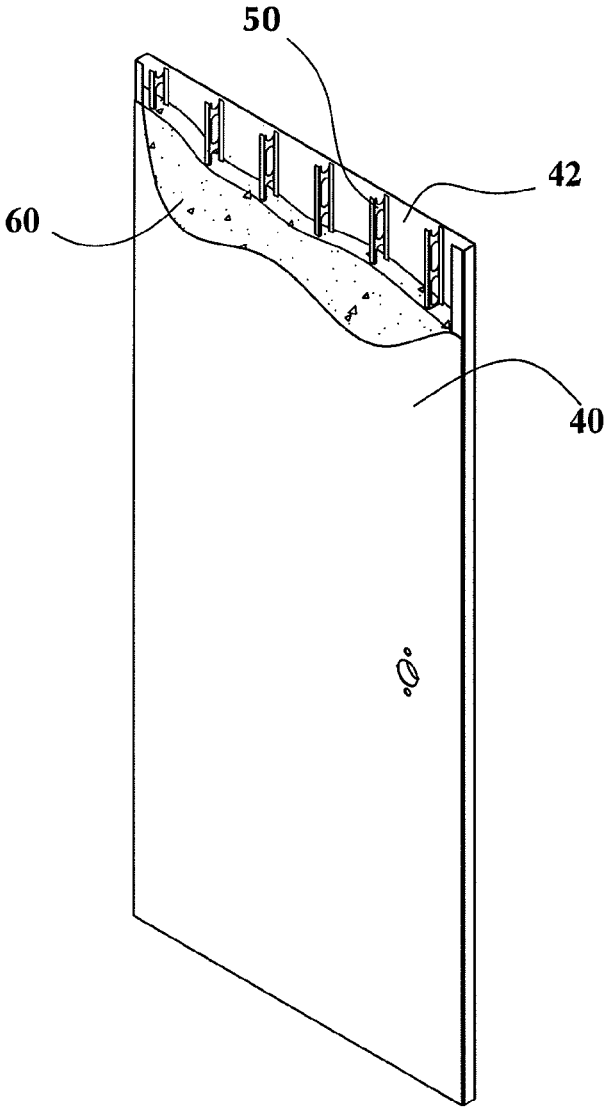
FIG. 10 is a perspective full cutaway view showing the stiffener subassembly in another embodiment of the insulated door that utilizes the insulation as a liner plate and bonding agent.

Referring to FIG. 10 in an alternate method of making the insulated steel door, a plurality of vertical stiffeners 50 are bonded to the external skins 40, 42 by the insulating material 60. In this method stiffeners 50 are suspended between the inner and outer panels 40, 42 forming cavities between adjacent stiffeners and between the inner and outer panels. Additionally, a space is created between at least one side of the stiffeners and the inside face of the adjacent exterior panel sufficient to allow flowable foam to flow between the at least one side of the stiffeners and the adjacent exterior panel. The method includes flowing the foam into the cavities and between the side of the stiffeners and the adjacent exterior panel until cavities are filled with the foam. The flowable foam then hardens and is bonded to the exterior panels and the stiffeners. In this method, the foam is an insulation material and bonds to the door skin and stiffeners as an adhesive. Also in this method, the insulation 60 itself forms the liner panel and is integral with the foam insulation between the adjacent stiffeners. In an alternate embodiment, the foam insulation 60 is not disposed between the stiffeners and the external skins.

Figure 11:
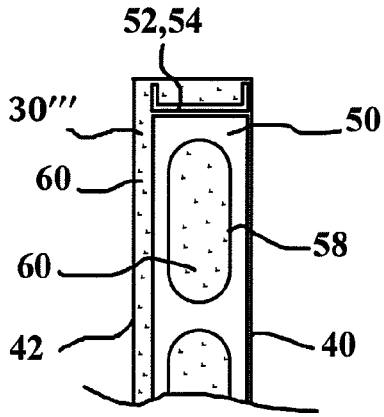
FIG. 11 is a cross sectional right side elevational view of a top portion of the door shown in FIG. 10.
Figure 12:
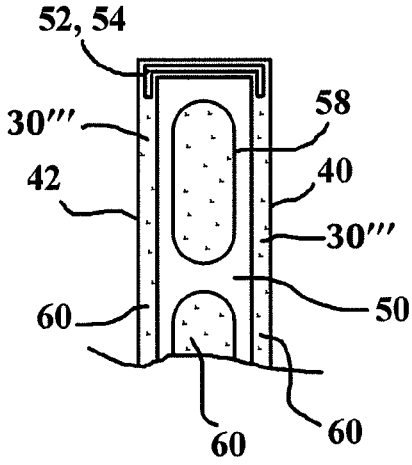
FIG. 12 is a cross sectional right side elevational view of an alternate embodiment of the top portion of the door shown in FIG. 10.

FIG. 11 is an enlarged cross sectional right side elevational view of the top portion of the door shown in FIG. 10 showing in greater detail that the foam insulation forms the liner panel 30''' contacting the inside face of exterior panel 42 between stiffener 50 and panel 42 and is an integral part of the insulation material 60. On the opposite side, stiffener 50 abuts the inside face of exterior panel 40, and no foam is present therebetween. The upper and lower stiffeners 52, 54 may have the open portion of the channel directed upward on the upper stiffener 52 and downward on the lower stiffener 54, allowing the upper and lower stiffeners to aid in suspending the vertical stiffeners 50 while setting up the door for inserting the flowable foam insulation. FIG. 12 shows an alternate embodiment wherein the liner panel 30''' may be formed against each of the inside face of exterior panels 40, 42 by creating a space between stiffener 50 and the exterior panels for entry of the foam 60 on both sides of the stiffener 50.

Thus, the present invention provides an insulated steel door which improves the structural integrity, is thermally efficient and provides an outer appearance free of weld marks. The door is readily manufactured by use of the insertable stiffener/liner panel subassembly, which holds the insulation.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An insulated door comprising:

a door shell having spaced first and second exterior panels; and a plurality of stiffeners bonded to a liner panel, with thermal insulation between adjacent stiffeners, the stiffeners, liner panel and thermal insulation being disposed within the door shell;

wherein the liner panel is disposed between one side of the stiffeners and one of the first or second exterior panels, with a whole surface of the liner panel being disposed directly against an interior face of the first or second exterior panels; wherein the liner panel extends along one side of the stiffeners and wherein the thermal insulation is along the liner panel between the stiffeners and the first and second exterior panels.

2. The door of claim 1 wherein the stiffeners are welded to the liner panel.

3. The door of claim 1 wherein the insulation material fills substantially all of the space between the liner panel and one of the first or second exterior panels.

4. The door of claim 1 wherein the liner panel is self supporting.

5. The door of claim 1 wherein the liner panel is insertable into the first or second exterior panels of the door shell.

6. The door of claim 1 wherein the liner panel comprises a self-supporting insulation material bonded to the stiffeners.

7. The door of claim 6 wherein the insulation material is present between the stiffeners and at least one of the exterior panels and bonds the stiffeners to the at least one exterior panel.

8. The door of claim 6 wherein at least one of the stiffeners has a thickness less than the distance between the first and second exterior panels.

9. The door of claim 1 wherein the stiffeners and the liner panel are made of steel, the stiffeners are welded to the liner panel, and the stiffeners are not welded to the first and second exterior panels of the door shell.

10. The door of claim 1 wherein the stiffeners are not welded to the first and second exterior panels of the door shell.

11. The door of claim 1 wherein the door shell further includes door edges extending between a periphery of the first and second exterior panels.

12. The door of claim 1 further including a hinge for securing the door shell to a door opening.

13. A method of making an insulated door comprising:

providing first and second exterior panels for a door shell;

providing a plurality of stiffeners bonded to a liner panel, the liner panel being disposed between one side of the stiffeners and one of the first or second exterior panels;

installing the liner panel against one of the exterior panels of the door shell with substantially a whole surface of the liner panel being disposed directly against an interior face of the exterior panels; installing the other of the exterior panels on a side of the door shell opposite the liner panel, either before or after installing the liner panel; and placing an insulation material between adjacent stiffeners along the liner panel, either before or after installing the exterior panel; wherein the liner panel extends along one side of the stiffeners and wherein the thermal insulation is along the liner panel between the stiffeners and the first and second exterior panels.

14. The method of claim 13 wherein the step of providing a plurality of stiffeners bonded to a liner panel includes providing the stiffeners welded to the liner panel.

15. The method of claim 13 wherein the step of placing the insulation material between adjacent stiffeners includes filling substantially all of the space between the liner panel and one of the first or second exterior panels.

16. The method of claim 13 wherein the liner panel is self supporting.

17. The method of claim 13 wherein the liner panel comprises a self-supporting insulation material bonded to the stiffeners.

18. The method of claim 17 wherein the insulation material is present between the stiffeners and at least one of the exterior panels and bonds the stiffeners to the at least one exterior panel.

19. The method of claim 17 wherein at least one of the stiffeners has a thickness less than the distance between the first and second exterior panels.

20. The method of claim 13 wherein the stiffeners and the liner panel are made of steel, the stiffeners are welded to the liner panel, and the stiffeners are not welded to the first and second exterior panels of the door shell.

21. The method of claim 13 wherein the stiffeners are not welded to the first and second exterior panels of the door shell.

22. The method of claim 13 wherein the door shell further includes door edges extending between a periphery of the first and second exterior panels.

23. The method of claim 22 further including providing a hinge for securing the door shell to a door opening and including fastening the hinge to at least one of the door edges at any step of the method.

24. An insulated door comprising:

a door shell having spaced first and second exterior panels; and a plurality of stiffeners between the first and second exterior panels such that each of the stiffeners has a first side facing the first exterior panel and a second side facing the second exterior panel, each stiffener being spaced from adjacent stiffeners, the stiffeners bonded to a liner panel; wherein a whole surface of the liner panel being disposed directly against an interior face of the first or second exterior panels; at least the first side of each of the stiffeners being spaced from the adjacent first exterior panel; and a hardened foam filled in the spaces between adjacent stiffeners and between the at least first side of the stiffeners and the adjacent first exterior panel, whereby the exterior panels and the stiffeners are bonded to the foam.

25. The insulated door of claim 24 wherein the door shell further includes door edges extending between a periphery of the first and second exterior panels.

26. The insulated door of claim 25 further including a hinge securing the door shell to a door opening.

* * * * *